US008146742B2

(12) United States Patent
Kumasaka

(10) Patent No.: US 8,146,742 B2
(45) Date of Patent: Apr. 3, 2012

(54) PACKING BODY

(75) Inventor: Yoshinori Kumasaka, Tokyo (JP)

(73) Assignee: Uni-Charm Corporation, Ehime (JP)

( * ) Notice: Subject to any disclaimer, the term of this patent is extended or adjusted under 35 U.S.C. 154(b) by 0 days.

(21) Appl. No.: 12/681,502

(22) PCT Filed: Oct. 2, 2008

(86) PCT No.: PCT/JP2008/067893

§ 371 (c)(1),
(2), (4) Date: Jul. 20, 2010

(87) PCT Pub. No.: WO2009/044792

PCT Pub. Date: Apr. 9, 2009

(65) Prior Publication Data

US 2010/0276307 A1 Nov. 4, 2010

(30) Foreign Application Priority Data

Oct. 5, 2007 (JP) ..... 2007-262518

(51) Int. Cl.
*A61B 17/06* (2006.01)

(52) U.S. Cl. ..... 206/440; 206/494; 206/459.5; 229/87.05

(58) Field of Classification Search ..... 206/736, 206/751, 774, 440, 494, 812, 459.1, 459.5, 206/438; 229/87.05
See application file for complete search history.

(56) References Cited

U.S. PATENT DOCUMENTS 3,918,631 A * 11/1975 Hackenberg ..... 229/208
5,553,733 A * 9/1996 Rosenthal ..... 428/35.2
6,112,936 A * 9/2000 Arizmendi ..... 221/45
6,173,837 B1 * 1/2001 Marconi ..... 206/457

(Continued)

FOREIGN PATENT DOCUMENTS

JP S56-6746 U 1/1981

(Continued)

OTHER PUBLICATIONS

International Search Report from corresponding PCT application No. PCT/JP2008/067893, dated Oct. 28, 2008, 4 pages.

*Primary Examiner* — Jacob K Ackun
(74) *Attorney, Agent, or Firm* — Brinks Hofer Gilson & Lione

(57) ABSTRACT

A packing body suitable as a portable packing body which can change the appearance under a state where an article is contained. The packing body (1) containing an article comprises a container main body (2) for containing an article, and an extending portion (3) extending outward of the container main body (2), with the outer side face of a central region in the height direction of the container main body (2) as the proximal end (31). The packing body (1) can be changed from a first mode where the extending portion (3) is arranged to cover the side of the first end (21) of the container main body (2) from the proximal end (31) to a second mode where the extending portion (3) is arranged to cover the side of the second end (22) of the container main body (2) by reversing the extending portion (3) along the proximal end (31). An opening (33) for exposing a second end face (24) on the side of the second end (22) at least in the second mode is formed at the extension end (32) of the extending portion (3).

15 Claims, 8 Drawing Sheets

U.S. PATENT DOCUMENTS

| | | | | |
|---|---|---|---|---|
| 6,347,703 | B1 * | 2/2002 | Betts | 206/457 |
| 6,688,466 | B2 * | 2/2004 | White et al. | 206/440 |
| 7,051,895 | B2 * | 5/2006 | Toussant et al. | 220/287 |
| 7,780,006 | B2 * | 8/2010 | Clark et al. | 206/494 |
| 2003/0088224 | A1 | 5/2003 | Ceman et al. | |
| 2004/0144679 | A1 * | 7/2004 | Sorebo et al. | 206/494 |
| 2005/0205456 | A1 * | 9/2005 | Meyer et al. | 206/525 |
| 2007/0151887 | A1 * | 7/2007 | Clark et al. | 206/494 |
| 2007/0163909 | A1 * | 7/2007 | Ice | 206/440 |

FOREIGN PATENT DOCUMENTS

| | | |
|---|---|---|
| JP | S63-267535 | 11/1988 |
| JP | H1-91753 U | 6/1989 |
| JP | H4-21447 U | 2/1992 |
| JP | 2000-43900 | 2/2000 |
| JP | 2000-281131 | 10/2000 |
| WO | WO2006/110415 | 10/2006 |

* cited by examiner

PACKING BODY

RELATED APPLICATION

This application is a 35 U.S.C. §371 national phase filing of International Patent Application No. PCT/JP2008/067893, filed Oct. 2, 2008, through which and to which priority is claimed under 35 U.S.C. §119 to Japanese Patent Application No. 2007-262518, filed Oct. 5, 2007.

TECHNICAL FIELD

The present invention relates to packaging body having an external appearance that can be changed while containing articles.

BACKGROUND ART

Generally, many articles such as sanitary napkins or disposable diapers are contained in packaging body and lined up in shops for sale. Therefore, a person who purchases the packaging body that contains many articles normally separates them and transfers a small number of the articles into a packaging body that is portable, such as a pouch, for carrying around.

Japanese Unexamined Patent Application Publication No. 2000-281131 (hereinafter referred to as Pat. Pub. 1) is known as a technology that does not require an operation to separate articles after purchase. A packaging body for thin-type sanitary napkins that is appropriate for carrying a small number of sanitary articles is disclosed in Pat. Pub. 1. The packaging body disclosed in Pat. Pub. 1 can carry a small number of sanitary articles without having to separate the articles into a pouch and the like after the purchaser purchases the packaging body at a store.

DISCLOSURE OF THE INVENTION

Problems to be Solved by the Invention

However, the appearance of the packaging body that contains the articles makes it possible to recognize at a glance what articles are contained in that packaging body when being sold in the store. It is preferable for the packaging body to have an eye-catching appearance (the outer package display) to increase consumer appeal. On the other hand, when the article packaging body is used for carrying the article, it is not preferable to ascertain the content of the packaging body from its external appearance. It is preferable for the packaging body to have an external appearance (the outer package display) that is comparatively not eye-catching.

There is a need to change the external appearance of the packaging body appropriately for portability by containing a small number of articles so the external appearance is eye-catching for sales at the store, and is not eye-catching when being carried about. However, the packaging body disclosed in Pat. Pub. 1 does not have any such innovation.

An object of the present invention is to provide packaging body that can be suitably used as a carrier, and that changes its external appearance (the outside surface display) in a state where articles are stored therein.

Means for Solving the Problems

In a first aspect, a packaging body storing articles therein, includes a container body storing the articles; and an extended portion that extends outward of the container body using a central region in a longitudinal direction at the outside surface of the container body as a base end; in which the packaging body can be changed from a first state where the extended portion is disposed to cover a first end that is one end in a longitudinal direction of the container body, to a second state where the extended portion is disposed to cover a second end that is another end in the longitudinal direction of the container body, by inverting the extended portion along the base end, and a projecting end on the extended portion forms an opening that exposes an end face of the another end in at least the second state.

In a second aspect, the packaging body described in the first aspect further includes an open-portion provided in a side of the second end of the container body that opens.

According to a third aspect, in the packaging body described in either the first or second aspect, the base end is positioned at the side of the second end in the central region.

According to a fourth aspect, in the packaging body described in any one of the first to third aspects, the projecting length from the extended portion to the projecting end is longer than the length from the base end to the second end in the container body.

According to a fifth aspect, in the packaging body described in any one of the first to fourth aspects, the extended portion has a closing means for closing the opening in a vicinity of the projecting end.

According to a sixth aspect, in the packaging body described in the fifth aspect, the closing means is composed of a string insertion portion disposed along the vicinity of the projecting end, and an endless string inserted therein.

According to a seventh aspect, in the packaging body described in any one of the first to sixth aspects, in the first state, the extended portion covers a first end in a state having a pair of tearable tearing portions extending from the projecting end toward the base end, and in the second state, the extended portion covers the second end in a state where the pair of tearing portions are torn.

According to an eighth aspect, in the packaging body described in any one of the first to seventh aspects, an external surface display of the packaging body in the first state is different from the external surface display of the packaging body in the second state.

In a ninth aspect, a packaging body includes an article; a container that stores the article; and an extended portion formed on an outer circumference of the container; the packaging body having a first display on one surface of the extended portion and a second display on another surface, in which an overall display of the container becomes for distribution and marketing relating to the first display by folding over the extended portion to a side of the container to a position that the first display is at an outside of the container, and the overall display of the container becomes for use relating to the second display by folding over the extended portion to the side of the container to a position that the second display is at the outside of the container.

In a tenth aspect, a packaging body includes a container body that stores articles; and an extended portion that extends outward of the container body using a central region in a longitudinal direction at an outside surface of the container body as a base end; in which the packaging body has a first state where the extended portion is disposed to cover a first end that is one end of the container body in the longitudinal direction from the base end, and a second state where the extended portion is disposed to cover a second end that is another end of the container body in the longitudinal direction from the base end.

Effects of the Invention

The packaging body of the present invention can be suitably used as a carrier, and can change its external appearance (the outer package display) when containing articles.

PREFERRED MODE FOR CARRYING OUT THE INVENTION

Figure 1:
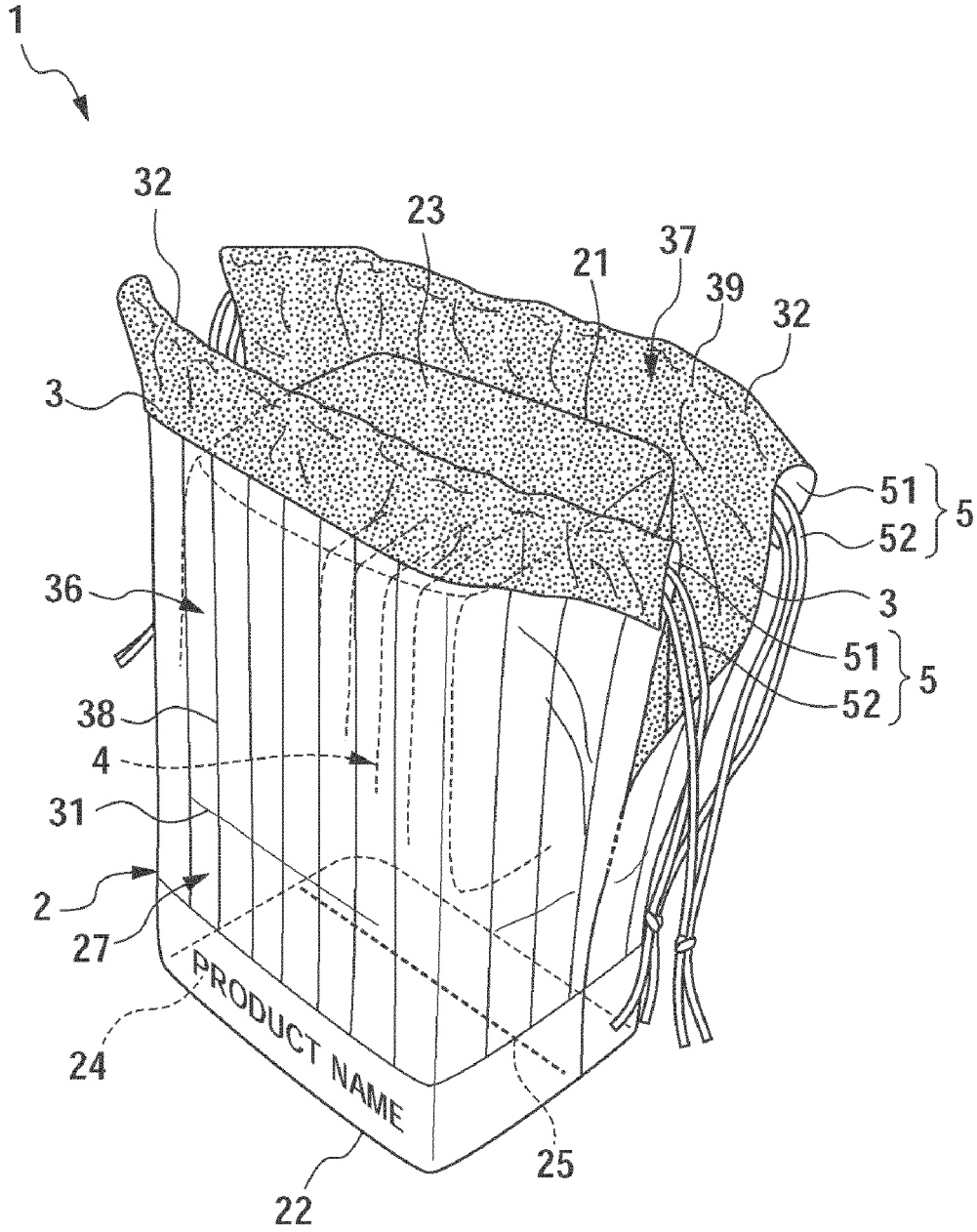
FIG. 1 is a perspective view of a first state in a first embodiment of the packaging body of the present invention.
Figure 2:
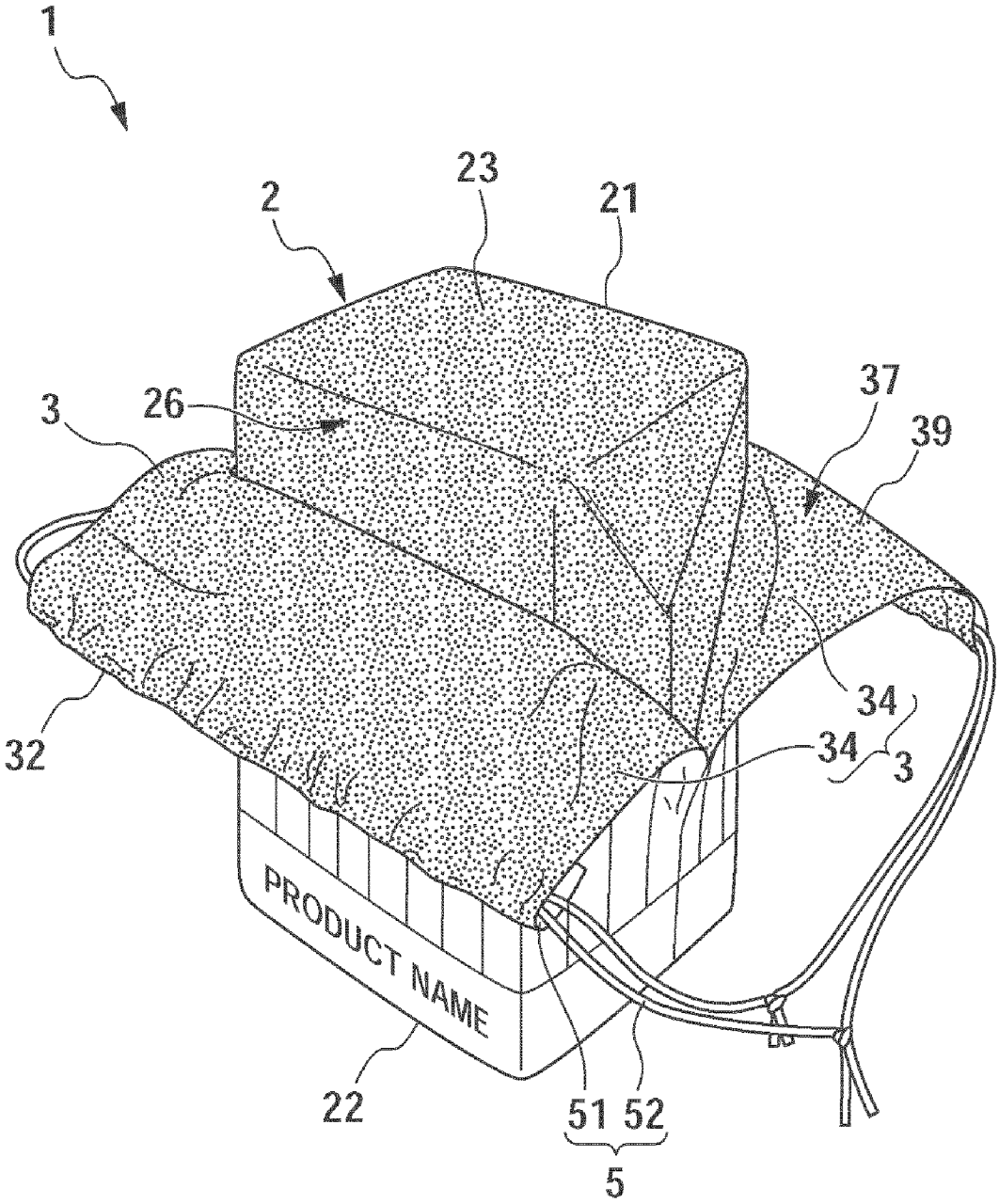
FIG. 2 is a perspective view of an extended portion turned inside out according to the first embodiment of the packaging body of the present invention.

The inventors have found that the aforementioned objects can be solved by composing the packaging body of a container body that stores articles, and a container extended portion that can cover the container body to complete the invention. Hereinafter, a first embodiment that is the preferred embodiment of a packaging body of the present invention is described with reference to the drawings provided.

As shown in FIGS. 1 to 5, the packaging body 1 of the first embodiment is provided with the container body 2 in which the articles 4 are stored, the external surface of the container body 2, and the extended portion 3 that extends outward of the container body 2 using a central region X as a base end 31. In other words, the packaging body 1 is composed of articles 4 and a container that contains articles 4, and the extended portion 3 is formed at the outer circumference of the container. More specifically, the container is composed of the container body 2 and the extended portion 3.

In addition, the packaging body 1 has a first state in which the extended portion 3 is disposed to cover a first end 21, which is one end in a longitudinal direction of the container body 2, and a second state in which the extended portion 3 is disposed to cover a second end 22, which is another end from the base end 31 in the longitudinal direction of the container body 2.

Figure 6A:
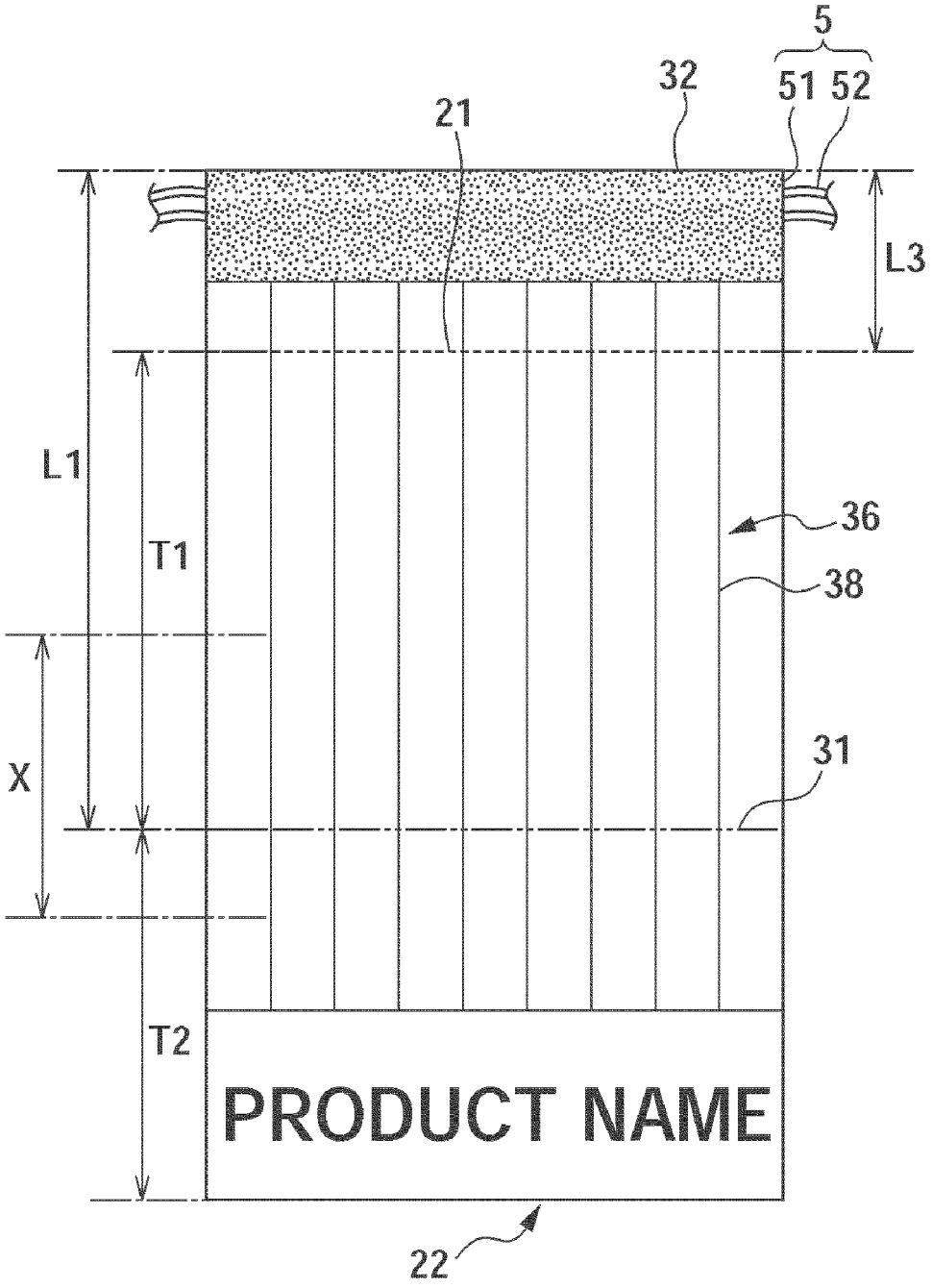
FIG. 6A is a plan view of the packaging body of the first embodiment showing a plan view of the first state.

It should be noted that in the present specification, the central region X in the longitudinal direction of the container body 2 indicates a region centrally positioned when the container body 2 is separated into three equal parts in the longitudinal direction, as shown in FIG. 6A.

Figure 4:
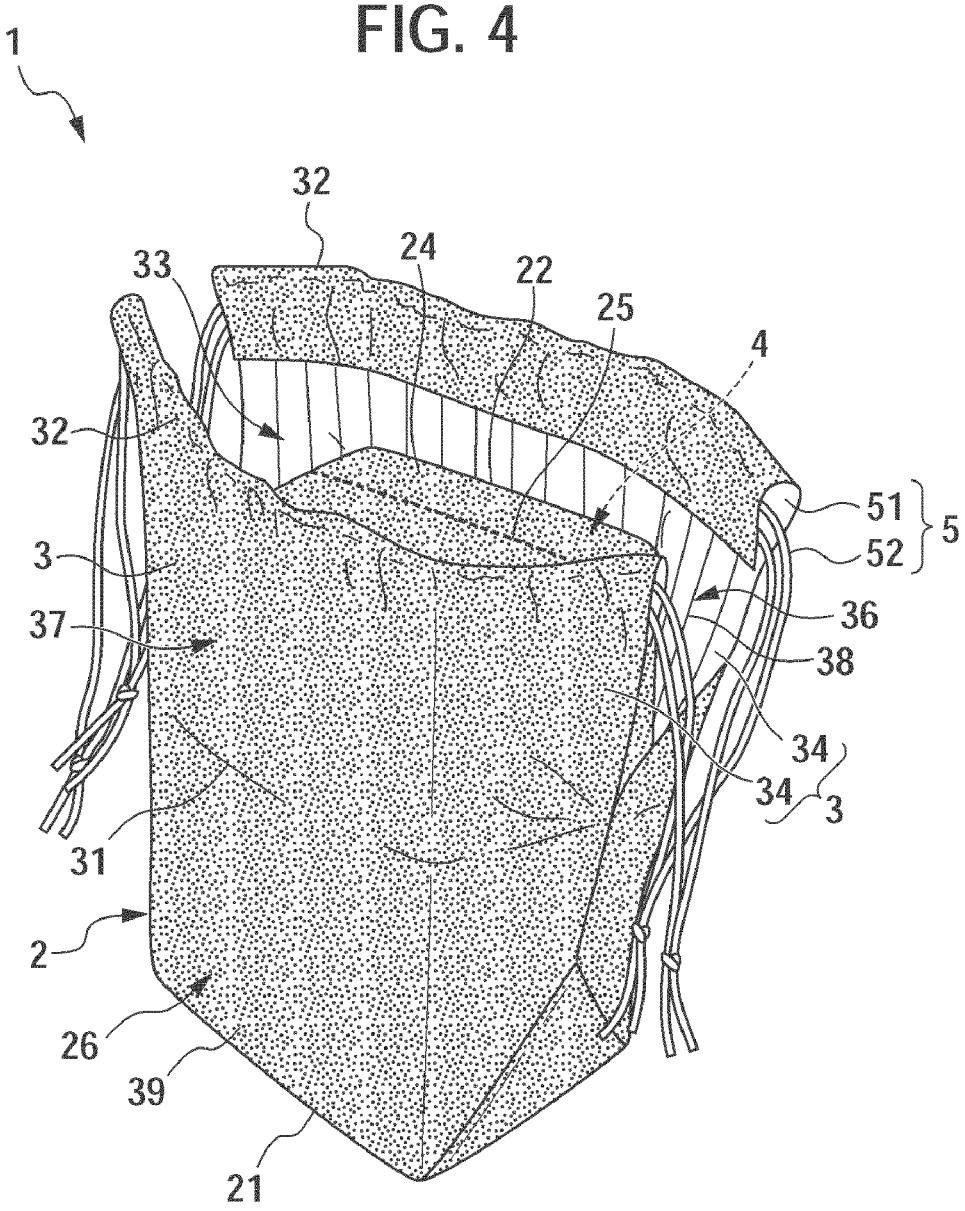
FIG. 4 shows the packaging body shown in FIG. 3 inverted from top to bottom.

In the first embodiment, the container body 2 has a longitudinal, substantially rectangular shape, as shown in FIG. 1, a first end surface 23 positioned at the first end 21, and a second end surface 24 positioned at the second end 22. In addition, as shown in FIGS. 1 and 4, an open-portion 25 is provided at the second end surface 24 to enable the articles 4 stored in the container body 2 to be removed. Articles 4 stored inside the container body 2 can be removed by the user opening the open-portion 25. In the first embodiment, the open-portion 25 is formed with perforations at the second end surface 24.

The extended portion 3 is composed of a sheet-shaped material. The base end 31, as shown in FIGS. 1 to 4, is formed to extend substantially over the entire circumference of the container body 2, and extends in a lateral direction perpendicular to the longitudinal direction of the container body 2. Furthermore, an extending end 32 that is the end portion on the opposite side of the base end 31 on the extended portion 3 is a free end.

Figure 6B:
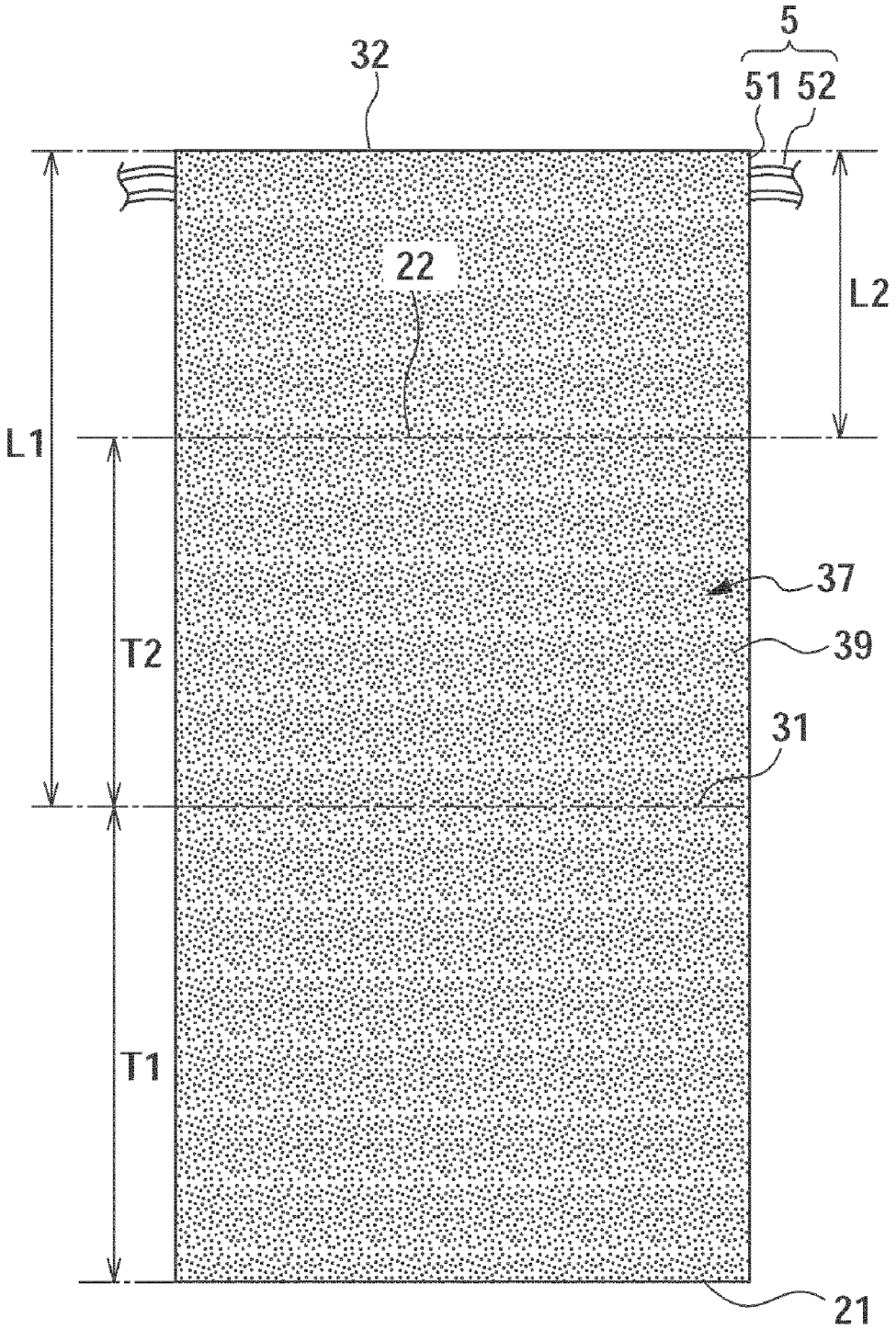
FIG. 6B is a plan view of the packaging body of the first embodiment showing a plan view of the second state.

As shown in FIGS. 6A and 6B, a projecting length L1 (the length from the base end 31 to the extending end 32) of the extended portion 3 is composed to be longer than a length T1 from the base end 31 to the first end 21 in the container body 2, and a length T2 from the base end 31 to the second end 22. Therefore, in the first and the second states, the extending end 32 of the extended portion 3 is positioned more to the outside in the longitudinal direction than the first end 21 and second end 22. Moreover, the base end 31 is positioned at the second end side, which is the central region of the container body 2. For that reason, the length L2 of the portion of the extended portion 3 positioned outside from the second end 22 of the container body 2 in the second state (see FIG. 6B) is longer than the length L3 (see FIG. 6A) of the portion of the extended portion 3 positioned outside of the first end 21 of the container body 2.

More specifically, at least a portion of the first end surface 23 and second end surface 24 can be covered and exposed by the portion positioned outside from the first end 21 and the second end 22 of the container body 2 in the extended portion 3. In other words, the opening 33 is formed in the extended portion 3 to make it possible to expose the first end surface 23 and the second end surface 24.

Here, in the first embodiment, substantially the entire circumferences of the first end surface 23 and the second end surface 24 are covered by the projecting end 32 of the opening 33 (see FIGS. 1 and 4); however, it is also acceptable for substantially the entire circumferences of the first end surface 23 and the second end surface 24 not to be covered by the projecting end 32 of the opening 33. In other words, it is acceptable to have a portion that is not covered by the projecting end 32 on a portion of the circumference of the first end surface 23 and the second end surface 24.

It should be noted that in the first embodiment, the projecting length L1 of the extended portion 3 is configured to be longer than the length T1 from the base end 31 to the first end 21 on the container body 2 and the length T2 from the base end 31 to the second end 22; however, it is also acceptable for the projecting length L1 of the extended portion 3 to be configured to be longer than the length T2 at least from the base end 31 to the second end 22. In other words, the opening 33 can be formed in at least the second state.

As shown in FIGS. 1 to 4, the extended portion 3 in the first embodiment is composed of a pair of substantially similarly shaped extended pieces 34, 34. Each of the pair of extended pieces 34 and 34 has a substantially rectangular shape. Loop-shaped string insertion portions 51 and 51 are formed along each of the pair of extended pieces 34 and 34 in the vicinity of the extending ends 32 and 32, and an endless string 52 is inserted in the pair of string insertion portions 51, 51. Specifically, two endless strings 52 are provided; one string is inserted into each of the pair string insertion portions 51 and 51.

The opening 33 formed in the first and second states can be closed using the pair of string insertion portions 51 and 51 disposed in the vicinity of the projecting end 32 and the endless strings 52 and 52 inserted into the pair of string insertion portions 51 and 51.

The extended portion 3 has a closing means 5 for closing the opening 33, which is composed of the pair of string insertion portions 51 and 51 disposed in the vicinity of the projecting ends 32, and the endless strings 52 inserted into the pair of string insertion portions 51 and 51.

More specifically, in at least the second state, the opening 33 is gathered together and closed by pulling the two strings inserted into the pair of string insertion portions 51 and 51. By closing the opening 33, it is possible to cover the exposed second end surface 24.

The packaging body 1 of the first embodiment having the configuration described above can change from the first state, where the extended portion 3 is disposed to cover the side of the first end 21 of the container body 2 from the base end 31, to the second state in which the extended portion 3 is disposed to cover the side of the second end 22 of the container body 2 by inverting the extended portion 3 along the base end 31.

The packaging body 1 has a first display 38 on a first surface 36 that is a surface on one side of the extended portion 3, and a second display 39 on a second surface 37 that is another surface. By inverting the extended portion 3 to the container body 2 side so that the first display 38 is positioned on the outside surface of the container (the first state), the display of the entire container becomes one for distribution and marketing relating to the first display 38, and by inverting the extended portion 3 to the container body 2 side so that the second display 39 is positioned on the outside surface of the container (the second state), the display of the entire container becomes one for use relating to the second display 39.

To explain further, in the first state, the outer surface 27 of the packaging body 1 is composed of an outer surface 27 on the container body 2 at the side of the second end 22 from the base end 31 and a sheet-shaped first surface 36 that is a surface of a side of the extended portion 3, as shown in FIG. 1. In this state, the outer surface 26 on the container body 2 at the side of the first end 21 from the base end 31 is covered by the extended portion 3. The second surface 37, which is a surface of another side of the extended portion 3, is disposed to oppose the outer surface of the container body 2 at the side of the first end 21 from the base end 31. In other words, in the first state, the outer surface 26 of the container body 2 at the side of the first end 21 from the base end 31 and the second surface 37 of the extended portion 3 cannot be visually recognized from the external appearance of the packaging body 1.

Figure 3:
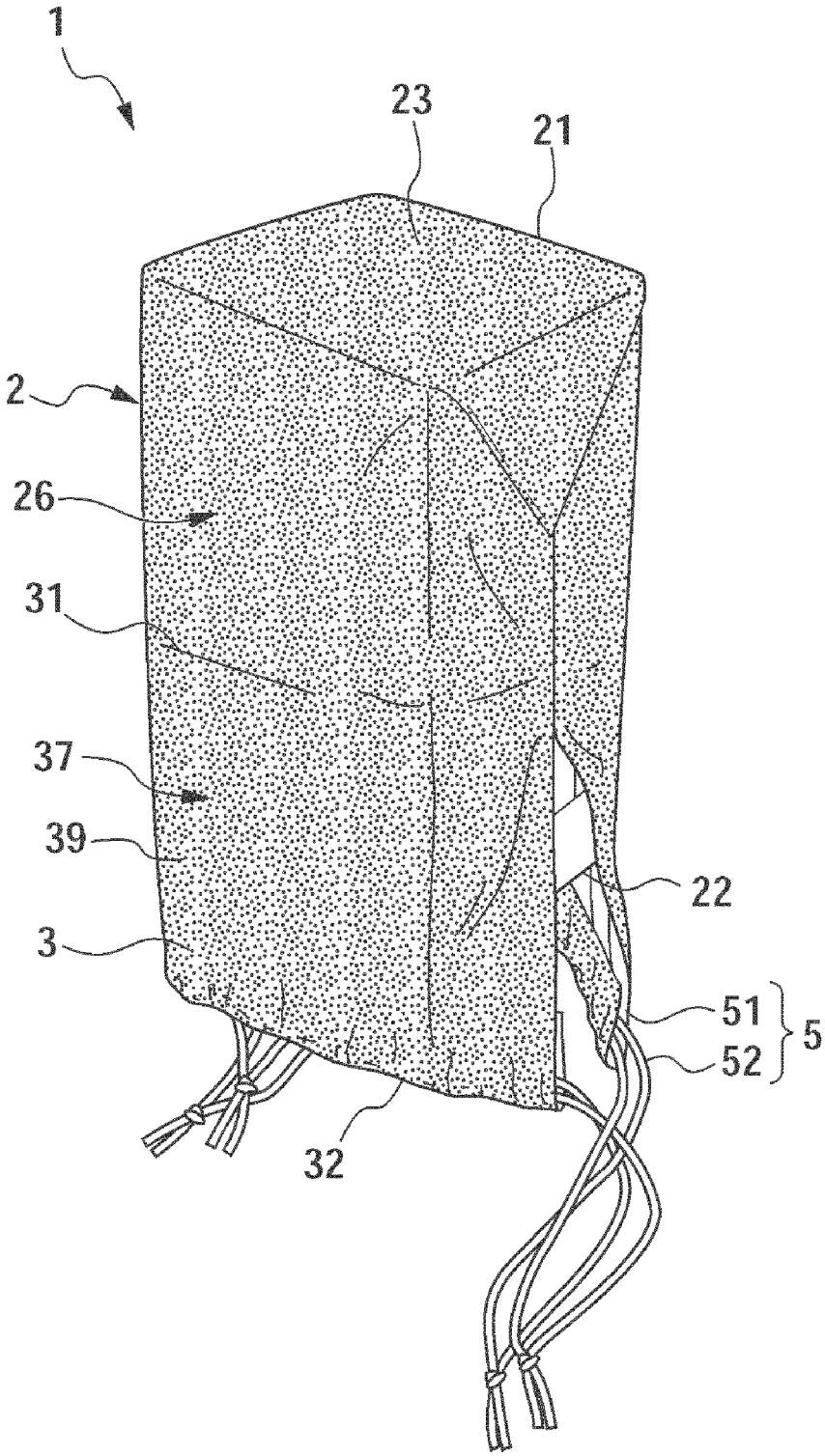
FIG. 3 is a perspective view of a second state according to the first embodiment of the packaging body of the present invention.

On the other hand, as shown in FIG. 3, in the second state, the outer surface of the packaging body 1 is composed of an outer surface 26 of the container body 2 at the side of the first end 21 from the base end 31, and a second surface 37 in the extended portion 3. In such a case, the outer surface 27 of the container body 2 at the side of the second end 22 from the base end 31 is covered by the extended portion 3. The first surface 36 in the extended portion 3 is disposed to oppose the outer surface 27 of the container body 2 at the side of the second end 22 from the base end 31. In other words, in the second state, the outer surface 27 of the container body 2 at the side of the second end 22 from the base end 31 and the first surface 36 of the extended portion 3 cannot be visually recognized from the external appearance of the packaging body 1.

In this way, the portion composing the outer surface of the packaging body 1 in the first state does not compose the outer surface of the packaging body 1 in the second state, and the portion composing the outer surface of the packaging body 1 in the second state does not compose the outer surface of the packaging body 1 in the first state.

Therefore, by applying different displays to the portion composing the outer surface of the packaging body 1 in the first state and to the portion composing the outer surface of the packaging body 1 in the second state, it is possible to make the external display of the packaging body 1 in the first state and the external display of the packaging body 1 in the second state different by only a simple operation of inverting the extended portion 3.

In the packaging body 1 of the first embodiment, it is possible to change from the first state to the second state by only inverting the extended portion 3, so that it is possible to change the external appearance of the packaging body 1 while the articles 4 are stored inside the container body 2.

In this way, it is possible to use the packaging body 1 of the first embodiment that can easily change the external appearance of the packaging body 1 to the first and second states while articles 4 are stored in the packaging body 1, and can vary the outer surface displays of the first and second states, in the following way.

The packaging body 1 of the first embodiment stores a plurality of articles 4 inside the container body 2, and the product can be displayed in the condition of the first state for marketing.

The packaging body 1 is displayed with the second end face 24 as its bottom surface in the condition of the first state. As shown in FIG. 1, in the first state, the outer surface of the packaging body 1 is composed of an outer surface 27 of the container body 2 at the side of the second end 22 from the base end 31 and a first surface 36 in the extended portion 3. Therefore, it is possible to recognize the content material on the first surface 36 and the outer surface 27 of the container body 2 at the side of the second end 22 from the base end 31. By providing an eye-catching display (first display 38) to increase a purchaser's buying intention, it is possible to make the outer appearance of the packaging body 1 in the first state appropriate for display and marketing.

In other words, the first state, where the external appearance of the container body 2 becomes the display for distribution and marketing, can be a display format of the packaging body 1.

Next, when the person who purchased the packaging body 1 wants to carry the packaging body 1, it is possible to change the packaging body 1 from the first state to the second state by inverting the extended portion 3 along the base end 31. Here, as shown in FIG. 4, in the second state, the outer surface of the packaging body 1 is composed of an outer surface 26 of the container body 2 at the side of the first end 21 from the base end 31 and a second surface 37 in the extended portion 3. Therefore, it is possible to make the external appearance of the packaging body 1 suitable for carrying in the second state by providing an inconspicuous display (second display 39) on the second surface 37 and the outer surface 26 of the container body 2 at the side of the first end 21 from the base end 31.

Figure 5:
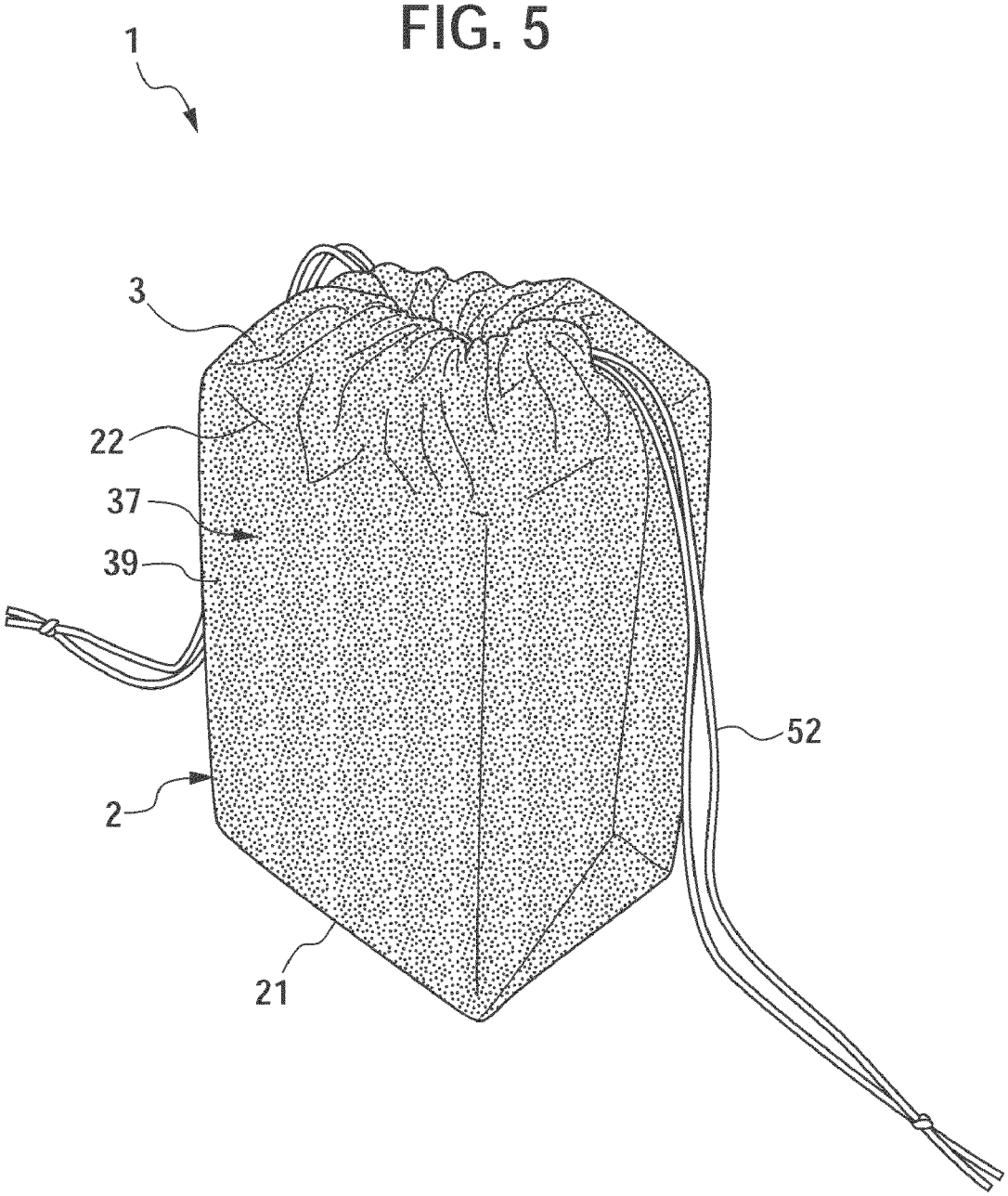
FIG. 5 is a perspective view showing an opening portion of the packaging body shown in FIG. 4 closed.

Therefore, in a state of carrying the packaging body 1, it is possible to remove the article 4 stored in the container body 2 by opening the open-portion 25 provided on the second end face 24 to use the article 4 stored in the container body 2 of the packaging body 1. Once the open-portion 25 is opened, the second end face 24 is in an opened state, but as shown in FIGS. 4 and 5, in the second state, the extended portion 3 is disposed to cover the second end face 24 and can close the opening 33 using a closing means 5. For that reason, by closing the opening 33 after the article has been removed, it is possible to prevent the articles 4 stored inside the container body 2 from coming out from the open-portion 25.

In the first embodiment, the closing means 5 is composed of the string insertion portions 51 and two endless strings 52 and 52 inserted therein, and the opening 33 can be closed by pulling these two strings 52 and 52 in mutually opposite directions. In other words, the packaging body 1 of the first embodiment can be used as a drawstring bag in the second state.

In this way, the second state in which the external appearance of the packaging body 1 becomes the display for usage can be a utilization format for the packaging body 1.

Next, the material that composes the packaging body 1 of the present invention will be explained.

As a material that composes the container body 2, it is possible to use a material that is ordinarily used in a packaging body without any particular restrictions. As a material, polyethylene, polypropylene, polyethylene terephthalate, polyamide, polystyrene, polycarbonate, polyvinylidene chloride, ethylene vinyl acetate copolymer, vinyl chloride, styrol, acrylonitrile, butadiene, styrene (ABS), and polybutylene terephthalate are examples.

Furthermore, the container body 2 can be composed of a package having a shape that can be easily changed, or the container body 2 can be composed of a box having adequate rigidity so that the shape does not easily deform. In a case where the container body 2 is composed of a box, there are no particular restrictions to its shape. As a shape of the container body 2, a square body, a cube, a cylinder, and a ball shape are examples.

In the first embodiment, the container body 2 is composed of a bag composed of a polyethylene sheet material.

For the sheet member that composes the extended portion 3, it is possible to use a material that can be used ordinarily as a material of packaging body material without any particular restrictions. As materials of the sheet member, polyethylene, polypropylene, polyethylene terephthalate, polyamide, polystyrene, polycarbonate, polyvinylidene chloride, and ethylene vinyl acetate copolymer can be given as examples.

In the first embodiment, the extended portion 3 is composed of the same sheet material as the polyethylene sheet material that composes the container body 2.

There are no restrictions to the article 4 stored inside the container body 2, as long as it is generally an article that is portable and can be carried. Absorbent articles such as sanitary napkins, panty-liners and disposable diapers, and snacks such as candy or chewing gum are examples of such articles.

For example, it is acceptable to store a tooth brush and tooth paste, shampoo and rinse and the like that are used when travelling, as a set inside the container body 2, and market that packaging body 1 as a travel set.

Next, a second embodiment of the present invention is explained with reference to FIG. 7.

Figure 7:
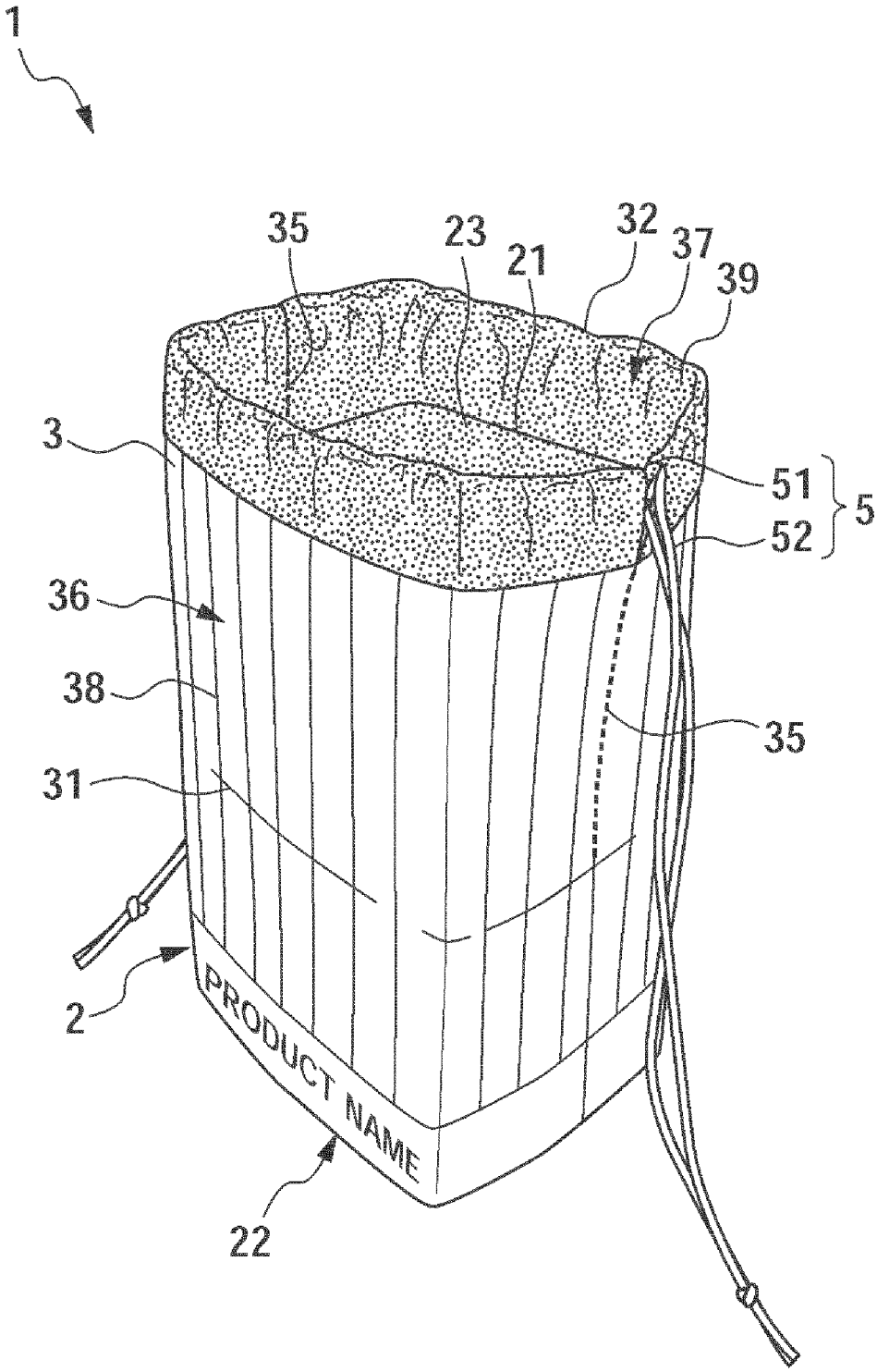
FIG. 7 is a perspective view of a first state according to a second embodiment of the packaging body of the present invention.

FIG. 7 is a perspective view of the first state in the second embodiment of the packaging body 1 of the present invention.

The main points of difference to the first embodiment will be explained for the second embodiment, and similar points will have the same symbols; however, explanations thereof will be omitted. The explanations of the first embodiment apply to those points that are not explained herein.

The packaging body 1 of the second embodiment differs from the first embodiment in that the extended portion 3 covers the first end 21 from the base end 31 having a pair of tearing portions 35 and 35 that can be torn, extending from the projecting end 32 toward the base end 31.

In the second embodiment, in the first state of the packaging body 1, the extended portion 3 is disposed to cover the first end 21 from the base end 31 as one body.

Therefore, to change the packaging body 1 from the first state to the second state, first the extended portion 3 is torn at the pair of tearing portions 35 and 35 provided on the extended portion 3. Next, the torn extended portion 3 is inverted along the base end 31 (see FIG. 2) and the extended portion 3 is disposed to cover the container body 2 at the side of the second end 22 from the base end 31 on (see FIG. 3).

In other words, the packaging body 1 in the second state covers the container body 2 at the side of the second end 22 from the base end 31 with the extended portion 3 torn at the pair of tearing portions 35 and 35.

The tearing portions 35 can be formed by joining the pair of extended pieces 34 and 34 in the first embodiment to be easily separable at their side edges. In addition, the tearing portions 35 are formed by providing perforations in the tubular-shaped extended portions 3 formed with the opening 33 at one end and the base end 31 at another end, extending from one end to the another end.

With the packaging body 1 of the second embodiment, in addition to the same effects attained with the first state, the extended portion 3 covers the first end 21 from the base end 31 on the container body 2 with a single body in the first state, so it is possible to prevent the extended portion 3 from being inverted unintentionally.

Furthermore, when inverting the extended portion 3, the extended portion 3 is torn at the tearing portions 35 so it is possible to easily change from the first state of the packaging body 1 to the second state.

The present invention is not limited to the foregoing embodiments, and variations may be made without departing from the scope of the invention.

For example, the packaging body 1 can be composed so that the projecting end 32 in the first embodiment is positioned to be more on the inside of the longitudinal direction of the container body 2 than the first end 21. This contributes to the stability in the first state when stacking and displaying the packaging body 1 in a plurality of levels. In other words, it is possible to prevent a loss of stability when displaying the packaging body 1 compared to when the projecting end 32 is configured to be positioned further outside in the longitudinal direction of the container body 2 than the first end 21.

Furthermore, in the first and second embodiments, the extended portion 3 is formed to extend from the base end 31 at substantially the entire circumference of the container body 2, but it is also acceptable for the extended portion 3 not to use substantially the entire circumference of the container body 2 as the base end 31. In other words, in the circumferential direction of the container body 2, it is acceptable to have a portion where the base end 31 of the extended portion 3 is not formed.

Furthermore, in the first and second embodiments, the container body 2 and the extended portion 3 are composed of the same sheet-shaped members, but it is also acceptable to compose the container body 2 and extended portion 3 from different members. For example, it is acceptable to use a box having adequate rigidity so as not to deform easily and to form the extended portion 3 by joining sheet-shaped members to have a base end 31 at the outside surface of the central region X of the container body 2.

Furthermore, in the first and second embodiments, the closing means 5 is composed of the string insertion portions 51 and endless strings 52 inserted in the string insertion portions 51, but the closing means 5 can be composed of male and female members of a mechanical zipper.

Moreover, the open-portion 25 is not limited to perforation as described in the first and second embodiment, but it can be formed by a mechanical zipper.

The invention claimed is:

1. An article packaging system which comprises:

an article compartment for containing articles, said article compartment having a closed top, a closed bottom and sides extending between the closed bottom and closed top; and a reversible outer cover which has a fixed end that is coupled to the sides of the article compartment along a circumference of the article compartment, and an opposite free end that can be moved between a first position in which the free end extends over the closed top of the article compartment and a second position in which the free end extends over the closed bottom of the article compartment wherein the closed bottom of the article compartment is provided with a weakened structure along which the closed bottom can be opened to access articles in said article compartment.

2. An article packaging system according to claim 1, wherein the free end of the reversible outer cover includes a closure mechanism by which the free end of the reversible outer cover can be closed.

3. An article packaging system according to claim 1, wherein the fixed end of the reversible cover is coupled to the side of the article compartment at an intermediate location between the closed bottom and closed top of the article compartment.

4. An article packaging system according to claim 1, wherein the fixed end of the reversible outer cover is located at a side of the closed bottom.

5. An article packaging system according to claim 1, wherein a length between the fixed end and the free end is longer than a length between the fixed end and the closed bottom.

6. An article packaging system according to claim 1, wherein the closure mechanism includes a string insertion portion arranged at the free end, and an endless string inserted therein.

7. An article packaging system according to claim 1, further comprising a tearable portion provided in the sides of the article compartment, wherein the tearable portion is torn when moving from the first position to the second position.

8. An article packaging system which comprises:

an article compartment for containing articles, said article compartment having a closed top, a closed bottom and sides extending between the closed bottom and closed top; and a reversible outer cover which has a fixed end that is coupled to the sides of the article compartment and an opposite free end that can be moved between a first position in which the free end extends over the closed top of the article compartment and a second position in which the free end extends over the closed bottom of the article compartment, wherein, when said reversible cover is in said first position, the outer appearance of the packaging system displays information that identifies the articles within the article compartment and when said reversible cover is in said second position the outer appearance of the packaging system does not display information that identifies the articles within the article compartment.

9. An article packaging system according to claim 8, wherein the free end of the reversible outer cover includes a closure mechanism by which the free end of the reversible outer cover can be closed.

10. An article packaging system according to claim 8, wherein the closed bottom of the article compartment is provided with a weakened structure along which the closed bottom can be opened to access articles in said article compartment.

11. An article packaging system according to claim 8, wherein the fixed end of the reversible cover is coupled to the side of the article compartment at an intermediate location between the closed bottom and closed top of the article compartment.

12. An article packaging system according to claim 8, wherein the fixed end of the reversible outer cover is located at a side of the closed bottom.

13. An article packaging system according to claim 8, wherein a length between the fixed end and the free end is longer than a length between the fixed end and the closed bottom.

14. An article packaging system according to claim 8, wherein the closure mechanism includes a string insertion portion arranged at the free end, and an endless string inserted therein.

15. An article packaging system according to claim 8, further comprising a tearable portion provided in the sides of the article compartment, wherein the tearable portion is torn when moving from the first position to the second position.

* * * * *